US006281328B1

(12) United States Patent
Sartori et al.

(10) Patent No.: US 6,281,328 B1
(45) **Date of Patent: *Aug. 28, 2001**

(54) PROCESS FOR EXTRACTION OF NAPHTHENIC ACIDS FROM CRUDES

(75) Inventors: Guido Sartori, Annandale; David William Savage, Lebanon; Bruce Henry Ballinger; David Craig Dalrymple, both of Bloomsbury, all of NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/643,201

(22) Filed: Aug. 22, 2000

Related U.S. Application Data

(63) Continuation-in-part of application No. 09/369,569, filed on Aug. 6, 1999, now Pat. No. 6,121,411.

(51) Int. Cl.[7] ..... C08F 6/14

(52) U.S. Cl. ..... 528/492; 528/491; 528/502 A; 528/502 D; 166/270; 166/274; 166/275; 166/300; 166/305 R

(58) Field of Search ..... 528/492, 491, 528/502 A, 502 D; 166/270, 274, 275, 300, 305 R

(56) References Cited

U.S. PATENT DOCUMENTS

| | | | |
|---|---|---|---|
| 2,068,979 | 1/1937 | Fisher | 196/35 |
| 2,770,580 | 11/1956 | Honeycutt et al. | 196/36 |
| 2,789,081 | 4/1957 | Mills | 196/36 |
| 2,795,532 | 6/1957 | Honeycutt | 196/36 |
| 3,318,809 | 5/1967 | Bray | 252/33 |
| 3,806,437 | 4/1974 | Franse et al. | 204/190 |
| 3,847,714 | 11/1974 | Jarrell | 204/190 |
| 3,994,344 | 11/1976 | Friedman | 166/270 |
| 4,033,860 | 7/1977 | Carlson | 208/206 |
| 4,163,728 | 8/1979 | Cheng et al. | 252/18 |
| 4,164,472 | 8/1979 | Cheng et al. | 508/460 |
| 4,179,383 | 12/1979 | Cheng et al. | 252/25 |
| 4,199,440 | 4/1980 | Verachtert | 208/230 |
| 4,226,739 | 10/1980 | Cheng et al. | 252/389 |
| 4,300,995 | 11/1981 | Liotta | 208/8 |
| 4,647,366 | 3/1987 | Edmondson | 208/47 |
| 4,752,381 | 6/1988 | Ferguson et al. | 208/263 |
| 5,011,579 | 4/1991 | Davis | 203/37 |
| 5,182,013 | 1/1993 | Peterson et al. | 206/348 |
| 5,643,439 | 7/1997 | Sartori et al. | 208/47 |
| 5,683,626 | 11/1997 | Sartori et al. | 252/389.62 |

FOREIGN PATENT DOCUMENTS

| | | | |
|---|---|---|---|
| SU1786060 | 1/1993 | (SU) | C10G/25/00 |
| WO9708270 | 3/1997 | (WO) | C10G/19/00 |
| WO9708271 | 3/1997 | (WO) | C10G/19/00 |
| WO9708275 | 3/1997 | (WO) | C10G/71/00 |

OTHER PUBLICATIONS

Kalichevsky, V.A.; Kobe, K.A., "*Petroleum Refining With Chemicals*", Elsevier Publishing Company, 1956.

Camp, E.Q.; Phillips, C., "*Neutralization as a Means of Controlling Corrosion of Refinery Equipment*", A paper presented at Fifth Annual Conference National Association of Corrosion Engineers, Apr. 11–14, Cincinnati, Ohio, Humble Oil and Refining Company, Baytown, Texas.

Mustafaev, S.A.; Ismailov, R.G.; Mirzoev, S.D. USSSR. Sb. Tr., Azerb. Inst. Nefti Khim. (1971), 64–6. From: Ref. Zh., Kim. 1972, Abstr. No. 13P244. Journal written in Russian.

CAN 78: 126538, "*Preparation of detergent and anticorrosion additives for lubricating oils from high–molecular–weight naphthenic acids*", SciFinder, Oct. 20, 1997.

Alekperova, S.A.; Vasilenko, G.V.; Shariforva, N.A. (USSR). Uck. Zap. Azerb. Gos. Univ., Ser. Khim. Nauk 1968, (1), 40–5 (Russ), "*Treatment of diesel fuel with the chemical sorbent KhP–I*", Chemical Abstracts, 72, 113446.

*Primary Examiner*—Duc Truong
(74) *Attorney, Agent, or Firm*—Linda M. Scuorzo

(57) ABSTRACT

The invention relates to processes for treating acidic crudes or fractions thereof to reduce or eliminate their acidity by addition of effective amounts of crosslinked polymeric amines having a pKa of greater than 9 such as polyvinyl amine and anionic exchange resins having amino groups. The process has utility for crude processing.

9 Claims, No Drawings

PROCESS FOR EXTRACTION OF NAPHTHENIC ACIDS FROM CRUDES

This application is a Continuation-In-Part under 35 U.S.C. 1.53(b) of U.S. Ser. No. 09/369,569 filed Aug. 6, 1999, now U.S. Pat. No. 6,121,411.

FIELD OF THE INVENTION

The present invention relates to a process for decreasing the acidity and corrosivity of crudes and crude fractions containing petroleum acids.

BACKGROUND OF THE INVENTION

Many petroleum crudes with high organic acid content, such as whole crude oils containing naphthenic acids, are corrosive to the equipment used to extract, transport and process the crude, such as pipestills and transfer lines.

Efforts to minimize naphthenic acid corrosion have included a number of approaches. Examples of such technologies include use of oil soluble reaction products of an alkynediol and a polyalkene polyamine (U.S. Pat. No. 4,647,366), and treatment of a liquid hydrocarbon with a dilute aqueous alkaline solution, specifically, dilute aqueous NaOH or KOH (U.S. Pat. No. 4,199,440). U.S. Pat. No. 4,199,440 notes, however, that the use of aqueous NaOH or KOH solutions that contain higher concentrations of the base form emulsions with the oil, necessitating use of only dilute aqueous base solutions. U.S. Pat. No. 4,300,995 discloses the treatment of carbonous materials particularly coal and its products such as heavy oils, vacuum gas oil, and petroleum residua, having acidic functionalities, with a quaternary base such as tetramethylammonium hydroxide in a liquid (alcohol or water). Additional processes using bases such aqueous alkali hydroxide solutions include those disclosed in Kalichevsky and Kobe, *Petroleum Refining With Chemicals*, (1956) Ch. 4, and U.S. Pat. Nos. 3,806,437; 3,847,774; 4,033,860; 4,199,440 and 5,011,579. Publications WO 97/08270, WO 97/08271 and WO 97/08275 published Mar. 6, 1997, collectively disclose treatment with overbased detergents and Group IA and IIA oxides and hydroxides to decrease acidity and/or corrosion. Certain treatments have been practiced on mineral oil distillates and hydrocarbon oils (e.g., with lime, molten NaOH or KOH, certain highly porous calcined salts of carboxylic acids suspended on carrier media). Whole crude oils were not treated.

U.S. Pat. Nos. 2,795,532 and 2,770,580 (Honeycutt) disclose processes in which "heavy mineral oil fractions" and "petroleum vapors", respectively are treated, by contacting "flashed vapors" with "liquid alkaline material" containing, inter alia, alkali metal hydroxides and "liquid oil" using mixture of molten NaOH and KOH as the preferred treating agent, with "other alkaline materials, e.g., lime, also employed in minor amounts." The treatment of whole crudes or fractions boiling at 1050 plus °F. ($565^{+}$° C.) is not disclosed; only vapors and condensed vapors of the 1050 minus °F. ($565^{-}$° C.) fractions, that is, fractions that are vaporizable at the conditions disclosed in '532 are treated. Since naphthenic acids are distributed through all crude fractions (many of which are not vaporizable) and since crudes differ widely in naphthenic acid content the '532 patent does not provide an expectation that one would be able to successfully treat a broad slate of crudes of a variety of boiling points or to use bases other than NaOH and KOH.

U.S. Pat. No. 2,068,979 discloses a method for preventing corrosion in a petroleum still by adding calcium naphthenate to petroleum to react with and scavenge strong free acids such as hydrochloric and sulfuric acids to prevent corrosion in distillation units. The patent makes no claims with respect to naphthenic acids, which would have been formed when the strong acids were converted to salts. Patents have disclosed, inter alia, the addition or formation of calcium carbonate (Cheng et al, U.S. Pat. No. 4,164,472) or magnesium oxide (Cheng et al, U.S. Pat. Nos. 4,163,728 and 4,179,383, and 4,226,739) dispersions as corrosion inhibitors in fuel products and lubricating oil products, but not in whole or topped crude oil. Similarly, Mustafaev et al. (Sb. Tr. Azerb. Inst, Neft. Khim. (1971) 64–6) reported on the improved detergency and anticorrosive properties of calcium, barium, and zinc hydroxide additives in lubricating oils. Calcium hydroxide (Kessick, Canadian Patent 1,249,760) has been used to aid in separation of water from heavy crude oil wastes. U.S. Pat. No. 3,994,344 (Friedman) discloses the use of low molecular weight polyethylenimine to treat crudes. However, the resulting polyamine with acid groups attached is dissolved in the oil.

There is a continuing need to develop methods for reducing the acidity and corrosivity of whole crudes and fractions thereof, particularly residua and other $650^{+}$° F. ($343^{+}$° C.) fractions. Applicants'invention addresses these needs.

SUMMARY OF THE INVENTION

The present invention provides for a method for decreasing the acidity of an acidic crude oil by contacting a starting acid-containing crude oil with an effective amount of a crosslinked polymeric amine having a pKa of greater than 9 to extract the acid groups from the oil to produce a treated crude oil having a decreased acid content and a crosslinked polymeric amine having the acid groups attached thereto. The amines are e.g., polyvinyl amine and anionic exchange resins containing amino groups. The crosslinked polymeric amine with acid molecules attached to it, which is insoluble in the crude, can be separated or otherwise isolated from the crude, e.g., by filtration or centrifugation, and regenerated by displacing the acids.

The present invention may suitably comprise, consist or consist essentially of the elements disclosed and may be practiced in the absence of an element not disclosed.

DETAILED DESCRIPTION OF THE INVENTION

Some whole crude oils contain organic acids such as carboxylic acids that contribute to corrosion or fouling of refinery equipment. These organic acids generally fall within the category of naphthenic and other organic acids. Naphthenic acid is a generic term used to identify a mixture of organic acids present in petroleum stocks. Naphthenic acids can cause corrosion at temperatures ranging from about 65° C. (150° F.) to 420° C. (790° F.). Naphthenic acids are distributed through a wide range of boiling points (i.e., fractions) in acid containing crudes. The present invention provides a method for broadly removing such acids, and most desirably, from heavier (higher boiling point) and liquid fractions in which these acids are often concentrated. The naphthenic acids may be present either alone or in combination with other organic acids, such as phenols.

Whole crude oils are very complex mixtures in which a large number of competing reactions may occur. Thus, the potential for successful application of a particular treatment or process is not necessarily predictable from the success of other treatments or processes.

The present invention may be used in applications in which a reduction in the acidity would be beneficial and in which oil-aqueous emulsion formation and large solvent volumes are not desirable. The decrease in acidity typically, is evidenced by a decrease in the neutralization number of the acidic crude or a decrease in intensity of the carboxyl band in the infrared spectrum at about 1708 $cm^{-1}$ of the treated (neutralized) crude.

The concentration of acid in the crude oil is typically expressed as an acid neutralization number or total acid number (TAN), which is the number of milligrams of KOH required to neutralize the acidity of one gram of oil. It may be determined according to ASTM D-664. Typically, the decrease in acid content may be determined by a decrease in the neutralization number or in the intensity of the carboxyl band in the infrared spectrum at about 1708 $cm^{-1}$. Crude oils with total acid numbers of about 1.0 mg KOH/g and lower are considered to be of moderate to low corrosivity. Crudes with a total acid number of 0.2 or less generally are considered to be of low corrosivity. Crudes with total acid numbers greater than 1.5 are considered corrosive.

The crudes that may be used are any naphthenic acid-containing crude oils that are liquid or liquifiable at the temperatures at which the present invention is carried out. Typically the crudes have TAN of 0.2 to 10 mg KOH/g. As used herein the term whole crudes means unrefined, undistilled crudes.

The contacting is typically carried out at a temperature from ambient temperature to 150° C., with narrower ranges suitably from about 20° C. to 150° C., preferably 30° C. to 150° C.

Corrosive, acidic crudes, i.e., those containing naphthenic acids alone or in combination with other organic acids such as phenols may be treated according to the present invention.

The acidic crudes are preferably whole crudes. However, acidic fractions of whole crudes such as topped crudes and other high boiling point fractions also may be treated. Thus, for example, 500° F. (260° C.) fractions, $650^{+\circ}$ F. ($343^{+\circ}$ C.) fractions, vacuum gas oils, and most desirably $1050^{+\circ}$ F. ($565^{+\circ}$ C.) fractions and topped crudes may be treated.

In the present invention the crude is contacted with an effective amount of a crosslinked polymeric amine having a pKa of greater than 9 to extract the acid groups from the oil. Examples of suitable compounds include polyvinylamine and anion-exchange resins containing amino groups. Typically, these amines are solid at starting reaction temperatures. Crosslinking may be carried out as known in the art, such as by treatment with peroxides or irradiation and produces a molecule of high molecular weight. In instances in which the monomer has been polymerized by a free radical mechanism, copolymerization with a suitable amount of difunctional monomer (e.g., divinyl benzene) leads to a crosslinked polymeric amine. Polyvinylamine also may be crosslinked by reaction with a dihalide, e.g., 1,2 dichloroethane or 1,5 dibromopentane. The material is typically added as a solid, which also may include a solid-in-liquid slurry, solid-in-water or solid-in-organic liquid slurry. Addition should be in a molar ratio effective to produce a neutralized or partially neutralized crude oil. Neutralization may be in whole or partial as desired and thus molar ratios of amine groups to acid groups can vary within broad ranges to effect the desired reaction. Typically from 0.1 to 20, more preferable 0.5 to 15, most preferably 1 to 15, may be used.

Some crudes themselves contain a sufficient amount of water, but typically water addition facilitates the reaction particularly if the crosslinked polymeric amine is dry.

After reaction with the acidic functionalities in the crude oil, the crosslinked polymeric amine with acids attached to it, which is insoluble in the crude, can be separated or otherwise isolated from the crude, e.g., by filtration or centrifugation. This is unlike prior art processes using low molecular weight (e.g., less than 600) amines since these are soluble in the crude and cannot be separated from it. Then the crosslinked polymeric amine may be regenerated and the acids recovered. Regeneration may be accomplished by displacing the acids via treatment with carbon dioxide in a suitable dispersant such as an aromatic hydrocarbon or with ammonia. The regenerated crosslinked polymeric amine may be recovered and recycled to treat additional acid containing crudes.

The formation of a crude oil-aqueous (i.e., either water-in-oil or oil-in-water) emulsion tends to interfere with the efficient separation of the crude oil and water phases and thus with recovery of the treated crude oil. Emulsion formation is undesirable and a particular problem that is encountered during treatment of naphthenic acid-containing crudes with aqueous bases. An additional benefit of the treatment is the absence or substantial absence of emulsion formation.

Suitable polymeric amines may be purchased commercially or synthesized using known procedures. In solid form, they may be in the form of a powder or a composite, sized particle or supported on a refractory (ceramic) matrix.

Reaction times depend on the temperature and nature of the crude to be treated, its acid content, but typically may be carried out for from less than about 1 hour to about 20 hours to produce a product having a decrease in acid content.

The present invention may be demonstrated with reference to the following non-limiting examples.

EXAMPLE 1

Comparative

The purpose of this example is to show that polymeric organic bases of insufficient basicity (pKa less than or equal to 9), such as polyvinylpyridines, do not significantly remove naphthenic acids from crudes.

The reaction apparatus was a 200-ml flask, equipped with stirrer and reflux condenser. 50 g of Bolobo 2/4, 2.5 g of water and 8 g of poly-4-vinylpyridine (commercially available), crosslinked by copolymerization with 2% divinylbenzene, were put into the flask. The mixture was brought to 100 degrees C. with stirring and kept there for 6 hours. After cooling, the solid was separated by centrifugation and the oil was submitted to analysis by infrared spectroscopy. The band at 1708 cm-1, attributed to carboxyl groups, was practically as intense as in untreated Bolobo 2/4, showing negligible removal of naphthenic acids. Titration, according to ASTM D-664, gave a total acid number (TAN) of 7.6 mg KOH/g of oil, i.e. practically identical to that of untreated Bolobo 2/4.

EXAMPLE 2

The reaction apparatus was a 200-ml flask, equipped with stirrer and reflux condenser. 50 g of Bolobo 2/4, having a total acid number of 7.6 mg KOH/g were put into the flask. 12.2 g of Amberlyst A-21, an anion-exchange resin prepared by chloromethylation of a styrene-divinylbenzene copolymer and subsequent reaction with an amine, were added. Then 2.5 g of water were added and the reactor contents were heated to 100 degrees C. and kept there for 6 hours. After cooling, the solid was separated by centrifugation. Titration of the oil according to ASTM D-664 gave a total acid number of 4.3 mg KOH/g. Examination by infrared spectroscopy showed that the band at 1708 cm-1 was 55% as intense as in untreated Bolobo 2/4.

What is claimed is:

1. A method for decreasing the acidity of an acidic crude oil, comprising: contacting a starting acid-containing crude oil or fraction having a neutralization number of from 0.2 to 10 mg KOH/g with an effective amount of a crosslinked polymeric amine having pKa greater than 9 and selected from the group consisting of polyvinylamine and anion-exchange resins containing amino groups, and wherein the molar ratio of amine groups in the crosslinked polymeric amine to acid groups is from 0.1 to 20 to produce a treated crude oil having a decreased acid content and a crosslinked polymeric amine having acid groups attached thereto, recovering the crosslinked polymeric amine with acid groups attached and regenerating the crosslinked polymeric amine to recover the acids.

2. The method of claim 1 wherein the molar ratio of amine groups to acid groups is from 0.5 to 15.

3. The method of claim 1 wherein the contacting is carried out in the presence of an effective amount of water.

4. The method of claim 1 wherein the crosslinked polymeric amine is added as a material selected from a solid and a solid-in-liquid slurry.

5. The method of claim 1 wherein the starting crude oil fraction is selected from crude fractions having a boiling point of 650$^{+\circ}$ F. (343$^{+\circ}$ C.) and 1050$^{+\circ}$ F. (565$^{+\circ}$C.).

6. The method of claim 1 wherein regenerating the crosslinked polymeric amine is carried out by treatment with $CO_2$.

7. The method of claim 1, wherein regenerating the crosslinked polymeric amine is carried out by treatment with $NH_3$.

8. The method of claim 1, further comprising recycling the regenerated crosslinked polymeric amine to treat additional, acid containing crude.

9. The method of claim 1, wherein regeneration is carried out by treatment with aqueous alkali metal hydroxide.

* * * * *